United States Patent [19]

Sjöström et al.

[11] 3,951,732

[45] Apr. 20, 1976

[54] DELIGNIFICATION AND BLEACHING OF WOOD PULP WITH OXYGEN IN THE PRESENCE OF TRIETHANOLAMINE

[75] Inventors: Eero Vilhelm Sjöström, Kauniainen; Olli Tapio Valttila, Niittykumpu, both of Finland

[73] Assignee: A. Ahlstrom Osakeyhtio, Finland

[22] Filed: Nov. 5, 1973

[21] Appl. No.: 412,794

[30] Foreign Application Priority Data

Nov. 16, 1972 Finland ..... 3233/72

[52] U.S. Cl. ..... 162/65; 162/72; 162/90

[51] Int. Cl.[2] ..... D21C 9/10

[58] Field of Search ..... 162/65, 72, 90

[56] References Cited

UNITED STATES PATENTS

| | | | |
|---|---|---|---|
| 2,192,202 | 3/1940 | Peterson et al. | 162/72 X |
| 2,668,110 | 2/1954 | Spencer et al. | 162/72 X |
| 3,384,533 | 5/1968 | Robert et al. | 162/65 |
| 3,423,282 | 1/1969 | Rerolle et al. | 162/65 |
| 3,769,152 | 10/1973 | Samuelson et al. | 162/65 |

OTHER PUBLICATIONS

Rydholm, Pulping Processes, 1970, p. 839.

*Primary Examiner*—Robert L. Lindsay, Jr.
*Assistant Examiner*—Arthur L. Corbin
*Attorney, Agent, or Firm*—Bucknam and Archer

[57] ABSTRACT

Wood pulp is delignified and bleached with oxygen in the presence of a mixture of an alkali, a magnesium compound and TEA.

7 Claims, No Drawings

DELIGNIFICATION AND BLEACHING OF WOOD PULP WITH OXYGEN IN THE PRESENCE OF TRIETHANOLAMINE

BACKGROUND OF THE INVENTION

1. Field of the Invention

The present invention relates to a process for stabilizing a hydrocarbonaceous fiber material, especially wood pulp, by an oxidizing alkaline treatment.

2. Description of the Prior Art

The use of oxygen in bleaching cellulose and in delignification processes in general has become an object of growing interest all over the world in recent years. The oxygen-alkali bleaching has considerable advantages when compared with the conventional processes using chlorine chemicals, especially because the enviornmental pollution caused by the dissolved organic material is easier to prevent. Nowadays a considerable part of the waste water load of the factories producing bleached cellulose is produced in connection with bleaching, because usually the organic material present in the waste liquors and which contains, among other things, chlorinated lignin, cannot be eliminated at a reasonable expense. But, the waste liquor from oxygen-alkali bleaching can be concentrated and burned by conventional methods, and the remaining chemicals (alkali) can be recovered and reused.

An important progress took place in oxygen-alkali bleaching technology in the late 1960's after it had been noted that magnesium salts prevent the oxidizing alkaline depolymerization of carbohydrates (French Pat. No. 1,387,853 (1964)). When magnesium carbonate, for example, is added to wood pulp after digestion, the pulp can be treated with oxygen and alkali without causing the cellulose to depolymerize too much in this treatment and thereby worsening the mechanical properties of the obtained fiber too much. It was later suggested that it is advantageous to add magnesium in the form of salts which form complexes with it (Swedish Pat. No. 314,531 (1970)).

Even though the use of magnesium salts has had a great effect on the progress of the oxygen-alkali bleaching process towards the stage of technological realization, it is not yet possible to use solely oxygen in bleaching when normal fully bleached paper pulp is concerned. When the delignification with oxygen is carried too far, the mechanical properties of the fiber suffer greatly even though the above magnesium salts are used as inhibitors in the bleaching. According to current technology, possibly about half of the lignin can be removed with oxygen when a normal chemical sulphate pulp is concerned (Tappi 54 (1971) 1893). In order to achieve a complete delignification, other bleaching chemicals must also be used, usually chlorine and oxidizers based on it. It is clear that the advantages of oxygen-alkali bleaching would become more obvious if the depolymerization of the carbohydrates could be more effectively prevented, in which case the use of chlorine and chlorine chemicals could be reduced or possibly eliminated.

On the basis of the above, systematic experiments have been carried out with the goal of discovering new agents which would work as inhibitors with maximum possible effectiveness in oxygen-alkali bleaching. Cerium and uranium salts and silver proved quite effective among the approximately twenty inorganic compounds tested but their practical application will obviously not be feasible owing to their high price. However, experiments with these materials elucidated the nature of the depolymerization mechanism of carbohydrates, and further investigations were concentrated on organic compounds of a certain type.

SUMMARY OF THE INVENTION

As the result of long-time work it was observed that certain amines have an ability to protect carbohydrates against an oxidizing alkaline depolymerization. According to the invention the agent used for protecting carbohydrates in the said type of process is triethanolamine (TEA). To obtain maximum efficiency, it is preferable to use triethanolamine together with magnesium compounds. Magnesium carbonate, magnesium sulphate magnesium oxide, magnesium hydroide, and organic acids which form complexes with magnesium are magnesium salts which can be used. It is preferable to use triethanolamine at a rate of 0.001–3% and magnesium salts at a rate of 0.01–1% of the dry weight of the material to be treated. The process can be carried out advantageously at a temperature of 80°–130°C, the alkali strength being at the most 10% NaOh calculated from the dry weight of the material to be treated, the pulp concentration 15–35% , and the overpressure of oxygen at least 1 kp/cm² (kilogram per square centimeter) at the beginning of the treatment.

DESCRIPTION OF THE PREFERRED EMBODIMENTS

Obviously the effect of TEA is partly due to the fact that it is able to bind the heavy metals contained in the pulp, and the radical reactions taking place under the influence of these metals are thereby prevented or weakened. Separate experiments proved that in strongly alkaline solutions TEA is also capable of binding considerable amounts of iron, which is usually present in the pulp as an inpurity even after the most careful wash. TEA proved to be an approximately equally effective inhibitor as magnesium compounds. As an additional advantage it was noted that the degree of whiteness of the bleached pulp was improved by an addition of TEA. Besides, it was observed that an addition of TEA together with magnesium salts provided an even better effect than the use of magnesium salts alone. Because TEA is a soluble compound, its use seems obviously advantageous in view of technological applications. For example, in connection with the evaporation and burning of waste liquor, magnesium may cause problems in the form of precipitation, while the use of TEA does not cause these problems. Furthermore, since TEA is a widely used and inexpensive commercial chemical, its use seems to provide several new possibilities. The effect of TEA in the oxygen-alkali bleaching will be described in more detail below in the light of the following examples. The amount of magnesium compounds, calculated as magnesium carbonate, is 0.01–1%.

EXAMPLES

Example 1

Unbleached pine sulphate pulp with a kappa number (SCAN Cl:59) of 28.3 and a lignin content, spectrophotometrically measured, of 3.71% was used in the experiment. Before the oxygen-alkali treatment, the pulp was washed with a dilute hydrochloric acid and thereafter with water. The oxygen-alkali treatment was carried out in a ½-liter pressure bomb (10 g bone dry pulp) lined with teflon, the conditions being as follows: pulp concentration 25%, alkali dose 4.8% NaOh bone dry pulp, initial oxygen pressure 6 kp/cm², total duration of treatment 1 hour, and maximum temperature 120°C.

The additives used as inhibitors (TEA and magnesium salts) were mixed into the alkali liquor, whereafter the pulp sample was added. After homogenization, excess liquor was removed from the pulp by filtering and pressing so that the obtained dry matter content of the pulp was 25%.

The heating took place by placing the pressure bomb in a polyethylene glycol bath. After bleaching, the bomb was cooled and opened and the pulp was washed carefully, torn apart by hand, and air dried.

The yield was determined by drying the pulp sample in a thermal chamber (103°±2°C). In addition, its viscosity was measured (in Cadoxen solution (Das Papier 15 (1961) 6), and the respective DP values were calculated from the viscosity values (Ind. Eng. Chem. Process Design Develop. 2 (1963) 57). The lignin-content was determined by spectrophotometry (Svensk Papperstidn. 69 (1966) 469).

Some typical results of these experiments are given in Table 1.

Table 1.

Effect of TEA on stability of pulp in oxygen-alkali treatment

| Additive | Doze % of pulp | Yield from bleaching % | Lignin content % | Marginal viscosity dl/g decileter per gram) | $DP_r$ degree of polymerization) |
|---|---|---|---|---|---|
| | — | 89.2 | 0.58 | 2.69 | 620 |
| TEA | 0.03 | 90.0 | 0.51 | 3.22 | 740 |
| TEA | 0.15 | 90.8 | 0.51 | 3.90 | 900 |
| TEA | 0.9 | 92.3 | 0.50 | 4.98 | 1150 |
| $MgSO_4$ | 0.6 | 92.4 | 0.51 | 5.02 | 1150 |
| $MgCO_3$ | 1.0 | 92.8 | 0.58 | 5.09 | 1170 |
| TEA X) $MgSO_4$ | 0.9 0.6 | 93.3 | 0.49 | 5.44 | 1250 |
| Initial (unbleached) pulp | | — | 3.71 | 7.28 | 1670 |

X) Added together

As can be seen from these results, the original pulp depolymerizes to a considerable extent in the oxygen-alkali treatment, which in this case has been carried out so far that 85–90% of the lignin contained in the pulp has been removed. The yield losses are about 10% without additives, which means that over 6% of the carbohydrate material contained in the pulp has been removed in the bleaching process. Furthermore, it can be determined from the viscosity and DP (degree of polymerization) values that the carbohydrates remaining in the pulp have become depolymerized to a considerable extent.

Even in small doses the added TEA has a protective effect on the carbohydrates. When the dose is increased to about 1% of the dry weight of the pulp, approximately the same effect is obtained as when adding a respective amount of $MgCO_3$. It is especially interesting and valuable from the practical viewpoint that the effect of TEA is synergistic when it is used together with Mg salts. Thus TEA and $MgSO_4$ together stabilize cellulose much more effectively than Mg salts alone. Out of the some forty additives we tested, TEA proved the best, and the said combination together with Mg salts is obviously the best of the currently known stabilization systems in oxygen-alkali bleaching. It is also worth mentioning that TEA does not complicate delignification as most of the other experimented additives do, but rather the delignification is improved.

Example 2

When investigating the effect of a TEA addition on the paper technological properties of pulp, separate oxygen-alkali treatments were carried out with larger pulp amounts in another apparatus. The following conditions were used in these experiments: pulp concentration 25–22%, alkali dose 3% NaOH/bone dry pulp, initial oxygen pressure 6 kp/cm², total duration of the bleaching 1 hour, and temperature 90°–98°C.

In order to prevent the magnesium from precipitating in the alkali, it was added in the form of gluconate. A sodium hydroxide solution of a suitable strength which contained the additive was caused to become absorbed in the pulp (200 g calculated as abs. dry material). The pulp was transferred into a perforated basket, which was placed in a vapor-phase boiler. The initial heating to about 100°C took place with direct vapor for about 1 minute, during which the pulp concentration decreased from 25% to 22% owing to the condensation of the vapor. The air and the water vapor present in the boiler were replaced with oxygen, whereafter the oxygen pressure was controlled (6 kp/cm²). After bleaching, the pulp was diluted with water, dispersed in a Wennberg disperser, washed in a centrifuge, and homogenized.

The pulp yield was determined as in Example 1, but the viscosity was measured in a Cuen solution (SCAN-C15:62). The paper technological properties of the pulp were determined after grinding (PFI mill).

The results of these experiments are shown in Tables 2 and 3. It can be observed from the first table that both the Mg addition and the TEA addition had a considerable effect, even though pulp depolymerization could not be entirely eliminated. The TEA addition also improved the degree of whiteness of the pulp.

Table 2.

Effect of TEA on chemical properties add degree of whiteness of oxygen-alkali-treated pulp

| | Yield from bleaching % | Kappa number | Marginal viscosity (SCAN) $cm^3/g$ | $DP_v$ | Degree of whiteness of pulp (SCAN) % |
|---|---|---|---|---|---|
| Initial pulp | — | 29.1 | 880 | 1512 | 32.0 |
| Pulp A (No additives) | 94.7 | 10.6 | 480 | 901 | 45.3 |
| Pulp B[x] (Mg addition) | 95.8 | 11.2 | 760 | 1376 | 44.0 |
| Pulp C[xx] (TEA addition) | 94.7 | 10.0 | 660 | 1180 | 47.7 |

[x]3.5% Mg gluconate/bone dry pulp
[xx]0.9% TEA/bone dry pulp

Table 3.

Effect of TEA on paper technological properties of oxygen-alkali-treated pulp (PFI grinding).

| | Tensile strength m | Bursting strength $m^2$ | Tearing strength $m^2$ | Folding strength |
|---|---|---|---|---|
| Initial pulp | | | | |
| 20°SR (Schopper Riegeler) | 6900 | 60.0 | 2.75 | 3000 |
| 30°SR | 8700 | 74.0 | 2.35 | 4850 |
| 50°SR | 9600 | 81.0 | 2.15 | 7350 |
| Pulp A (No additive) | | | | |
| 20°SR | 6550 | 54.0 | 2.10 | 1350 |
| 30°SR | 7650 | 64.0 | 1.80 | 2800 |
| 50°SR | 8400 | 68.0 | 1.60 | 4050 |
| Pulp B[x] (Mg addition) | | | | |
| 20°SR | 7200 | 63.0 | 2.80 | 2100 |
| 30°SR | 9000 | 81.0 | 2.20 | 3400 |
| 50°SR | 10050 | 87.0 | 2.05 | 6400 |
| Pulp C[xx] (TEA addition) | | | | |
| 20°SR | 7100 | 60.5 | 2.65 | 2150 |
| 30°SR | 8850 | 76.5 | 2.25 | 4750 |
| 50°SR | 9900 | 82.0 | 1.95 | 6200 |

[x]3.5 % Mg gluconate/bone dry pulp
[xx]0.9 % TEA/bone dry pulp

When observing the paper technological properties of the pulp (Table 3) it is noted that the strength properties, especially the folding strength, weaken significantly when the bleaching has been carried out without any additive. The effect of the TEA addition is approximately the same as that of the Mg-gluconate, and with the exception of the folding strength, the strength properties of the pulp keep well in the bleaching process.

According to the present invention, TEA proved by far the best among the great number of additives experimented with, except Mg salts, the effect of which was previously known. Table 4 gives, for the sake of comparison, the effects of certain other agents, out of which DTPA, HEDTA, 8-hydroxyquinoline-5-sulphonic acid and 2.3-dimercaptopropanol had never before been experimented with, while the effects of gluconic acid, NTA, and EDTA were previously known (Svensk Papperstidn. 74 (1971) 757). As can be seen, all of these agents have a stabilizing effect, but not nearly as strong as TEA.

Table 4.

Effects of certain organic additives on stability of pulp in oxygen-alkali treatment[x].

| Additive | Yield from bleaching % | Lignin content % | Marginal viscosity dl/g | $DP_v$ |
|---|---|---|---|---|
| DTPA | 90.2 | 0.64 | 3.16 | 730 |
| HEDTA | 89.8 | 0.62 | 3.16 | 730 |
| 8-hydroxy quinoline-5-sulphonic | | | | |

Table 4.-continued

Effects of certain organic additives on stability of pulp in oxygen-alkali treatment[x].

| Additive | Yield from bleaching % | Lignin content % | Marginal viscosity dl/g | $DP_v$ |
|---|---|---|---|---|
| acid | 90.6 | 0.56 | 3.14 | 720 |
| Gluconic acid | 89.9 | 0.55 | 3.07 | 710 |
| 2.3-dimercapto-propanol | 90.1 | 0.59 | 2.98 | 690 |
| EDTA | 91.0 | 0.66 | 2.78 | 640 |

[x]Bleaching conditions and pulp used are the same as in Example 1.

The present invention, which relates to the use of triethanolamine as an inhibitor in oxygen-alkali bleaching, is of special importance when the aim is to delignify chemical pulps to the minimum lignin contents possible. Even though the enclosed experiments were carried out with a chemical pine sulphate pulp, it is clear that the invention can also be applied to deciduous wood pulps and sulphite pulps as well as to carbohydrate-containing fiber materials in general when the purpose is to delignify them by an oxidizing alkaline treatment or to bleach the material without weakening the properties of the fiber too much. The improving effect of the TEA inhibitor on the degree of whiteness of pulp is of especially great importance in, among other things, the production of semi-bleached pulps or when combining oxygen bleaching with perioxide bleaching.

What is claimed is:

1. In a method of delignifying and bleaching wood pulp wherein the wood pulp is mixed with an alkali and a magnesium compound and the mixture is subjected to oxygent treatment at a temperature of 80°– 130°C, the improvement comprising including in the mixture of the wood pulp, the alkali magnesium compound, triethanolamine as a wood pulp protecting agent.

2. The method of claim 1, wherein the mixture of the wood pulp and the alkali contains from 0.01 to 3 percent triethanolamine and from 0.01 to 1 percent magnesium compounds, calculated as magnesium carbonate, by weight of the bone dry wood pulp.

3. The method of claim 1, wherein the magnesium compound is selected from the group consisting of magnesium oxide, magnesium hydroxide, magnesium carbonate, magnesium sulphate and complex compounds of magnesium and organic acids.

4. The method of claim 1, wherein the alkali is present in the amount of not more than 10 percent NaOH by weight of the bone dry wood pulp.

5. The method of claim 1, wherein a mixture of the wood pulp having a concentration of from 15 to 35 percent by weight, the alkali, the magnesium compound, and the triethanolamine is subjected to an initial oxygen pressure of at least 1 kp/cm².

6. The method of claim 1, wherein a mixture of unbleached sulphate pulp, having a concentration of from about 22 to 25 percent by weight, an aqueous solution containing from 3 to 5 percent NaOH by weight of bone dry pulp, 0.01 – 1% of a magnesium compound and 0.03 to 0.9 percent by weight triethanolamine is subjected to an oxygen pressure of from 1 to 6 kp/cm² at a temperature not exceeding 120°C and over a period of about one hour.

7. The method of claim 2, wherein the triethanolamine is added in an amount up to about 1%.

* * * * *